US005350122A

United States Patent [19]

Hundt et al.

[11] Patent Number: 5,350,122

[45] Date of Patent: Sep. 27, 1994

[54] WASTE RECYCLING DEVICE

[76] Inventors: Vincent G. Hundt, Rte. 1, Box 392, Coon Valley, Wis. 54623; Frederick G. Peltz, 26902 County Rd. 10, P.O. Box 301, St. Martin, Minn. 56376

[21] Appl. No.: 29,122

[22] Filed: Mar. 10, 1993

[51] Int. Cl.[5] ..... B02C 13/04; B02C 13/08

[52] U.S. Cl. ..... 241/29; 241/154

[58] Field of Search ..... 241/23, 29, 154, 186.4, 241/191, 192, 165.5

[56] References Cited

U.S. PATENT DOCUMENTS 4,039,150 8/1977 Ivarsson ..... 241/154

*Primary Examiner*—Douglas D. Watts

*Attorney, Agent, or Firm*—M. Paul Hendrickson

[57] ABSTRACT

Bulky waste materials may be effectively reduced to a desirable recycling particle size by a waste recycling device equipped with a preshredding chamber and a shredding chamber. Rotors equipped with differently shaped and configured impacting heads or blades strategically positioned about the rotors within the two chambers serve to break the waste materials into progressively smaller sized particles. The preshredding rotor is typically operated at a lower rotational speed than the shredding rotor. The shredding rotor may be equipped with shredding blades which protectively retract from a working zone when exposed to excessive shearing forces. Relatively rigid waste materials such as wooden pallets may be effectively and continuously reduced in massive quantities to a recyclable size with the waste recycling device.

18 Claims, 4 Drawing Sheets

WASTE RECYCLING DEVICE

FIELD OF THE INVENTION

The present invention relates to devices and methods for producing fragmented materials and more particularly devices and methods for reducing bulky materials to a desired particle size for recycling.

BACKGROUND OF THE INVENTION

There is a need for devices which have an extraordinary capacity to shred bulky objects in mass into recyclable materials. Current federal and state regulations pertaining to the disposal waste products (including waste wood products) have placed a premium upon converting such wastes into recyclable materials.

The need to shred bulky wooden objects into a more compact and recyclable form is typified by a need to dispose of spent or surplus wooden pallets. Such pallets are extensively used to stack goods and materials for shipment and warehousing. The wooden pallets are typically constructed of an upper and lower wooden planking nailed to wooden cross beams spaced so as to provide access for transport by forklift. The pallets are often used for stacking goods upon a series of stacked pallets. The pallets must necessarily be very durable in construction since the pallets must often support heavy objects and withstand stacking weight. The heavy duty construction makes it difficult to recycle the pallets.

Although such pallets are constructed for purposes of withstanding considerable abuse, the pallets are frequently irreparable damaged. It is also sometimes more economical to dispose of the pallets rather than to return or reuse the pallets. This can arise when the end user has essentially no need for the surplus pallets or the returning cost makes it unprofitable to reuse the pallets.

Mounting restrictions and regulations upon land fills and burning have created significant disposal problems, especially within metropolitan and industrial centers. The nails used to construct the pallets can cause considerable damage to conventional processing equipment. Conventional wood chippers fail to possess sufficient durability and efficacy to process such wooden pallets in mass. Consequently, the current wood chippers are typically ineffective and require extensive maintenance when continuously used to process, in mass, wooden pallets. The existing devices lack adequate capacity to effectively process the large volume of pallets which often accumulate at the final destination of a large volume pallet consumer. The ineffectiveness of such conventional wood chippers is also reflected by inefficient consumption of energy needed to simply process a relatively small volume of pallets.

There accordingly exists a need for a device capable of effectively disintegrating bulky and rigid structures such as wood pallets into particles of a recyclable size. Such a device must be able to withstand the impacting of wood pallets fed into the device at a high rate while also effectively discharging the processed material at a high discharge rate.

SUMMARY OF THE INVENTION

The present invention provides a device for shredding bulky objects, especially bulky wooden objects, into a shredded particle size suitable for recycling. The device includes a preshredding chamber and shredding chamber in which the bulky objects splintered within the preshredding chamber are advanced to the shredding chamber for shredding to the appropriate recycling particle size. The preshredding chamber includes a preshredding roller equipped with impacting heads rotationally balanced which splinters and propel the splintered objects to the shredding chamber. The shredding chamber includes a shredding roller fitted with numerous shredding blades, rotationally balanced, for shredding the splintered objects from the preshredding chamber to smaller sized recyclable particles. The shredded particles are discharged from the shredding chamber in a form suitable for recycling.

The preshredding roller is operated at a substantially lower r.p.m. than the shredding roller. The faster rotational speed of the shredding roller more effectively draws splintered objects from the shredding chamber. The higher rotational speed of the shredding roller causes upon impact the splintered objects to shatter and shed into the desired particle size. The shredding blades are suitably positioned in balanced rows having a helical rowed positioning of shredding blades therewith. The spacing between adjacent shredding blades within any given row is sufficient to provide reductions of the splintered objects to the desired particle size. The shredding blades include a unique shear pin assembly in which any given blade subjected to excessive shear or shredding resistance will break one of the mounting bolts and protectively pivot within the protective cover of a mounting ring.

The device is capable of effectively and continuously shredding massive amounts of bulky wooden objects. The device is extremely durable and requires a minimum level of periodic maintenance and repair to maintain the device at peak operational performance. Notwithstanding the massive output, the device maintains a quality level of recyclable output.

DETAILED DESCRIPTION OF THE INVENTION

Figure 1:
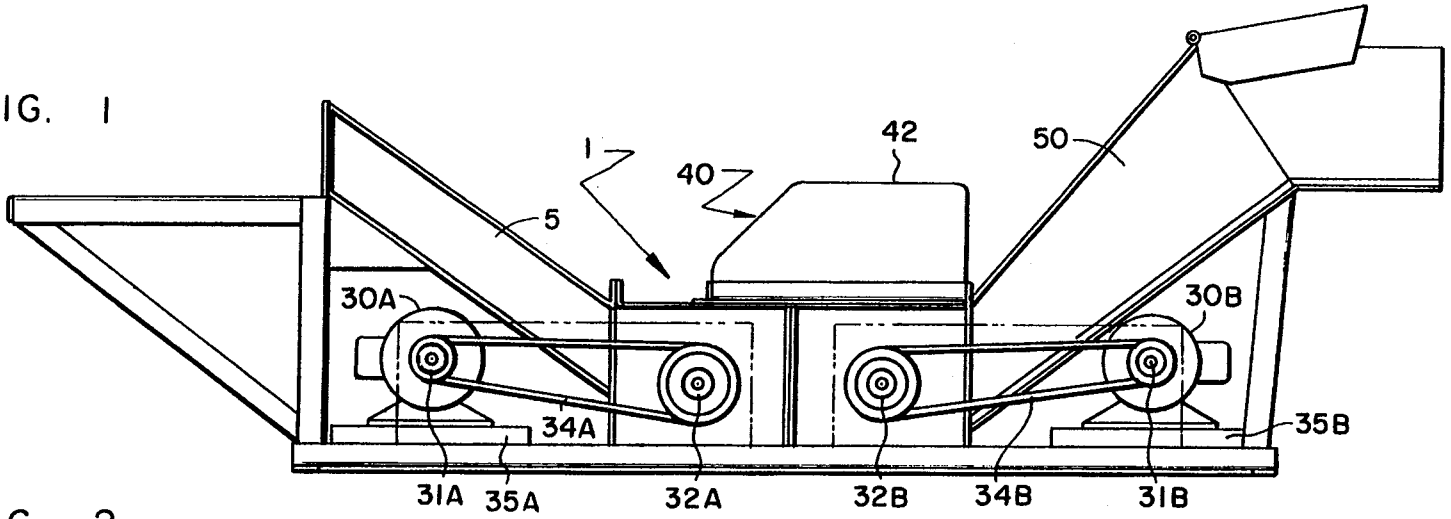
FIG. 1 is an external side view of the waste recycling device of this invention.
Figure 2:
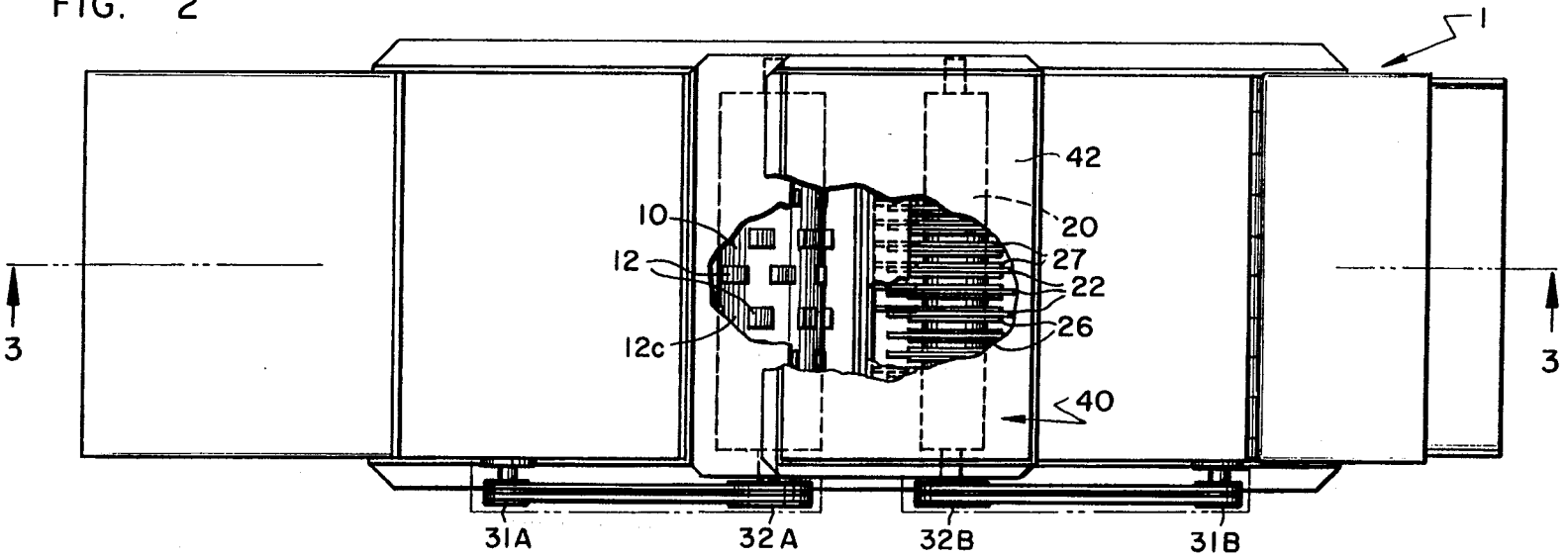
FIG. 2 is a top view of the device shown FIG. 1.

Referring to the FIGS. 1–10, there is provided in accordance with the present invention a device (generally designated as 1) for reducing bulky or waste objects (depicted as W in FIG. 3) to a more uniform and recyclable particle size, said device 1 comprising:

a) a preshredding rotor (generally designated as 10) equipped with a number of blunt impacting projections 12 for fragmenting the bulky objects W into intermediate sized fragments;

b) a shredding rotor (generally designated as 20) equipped with a plurality of shredding members 22 for shredding the fragments into smaller sized particles;

c) power driven means (generally prefixed by a 30 series number) for rotationally driving said preshredding rotor 10 and said shredding rotor 20 at substantially different rotational speeds;

d) means for advancing (generally prefixed by 40 series number) the fragments from said preshredding rotor 10 to said shredding rotor 20; and e) means for discharging (generally designated as a 50 series number) said particles from said device 1.

Figure 3:
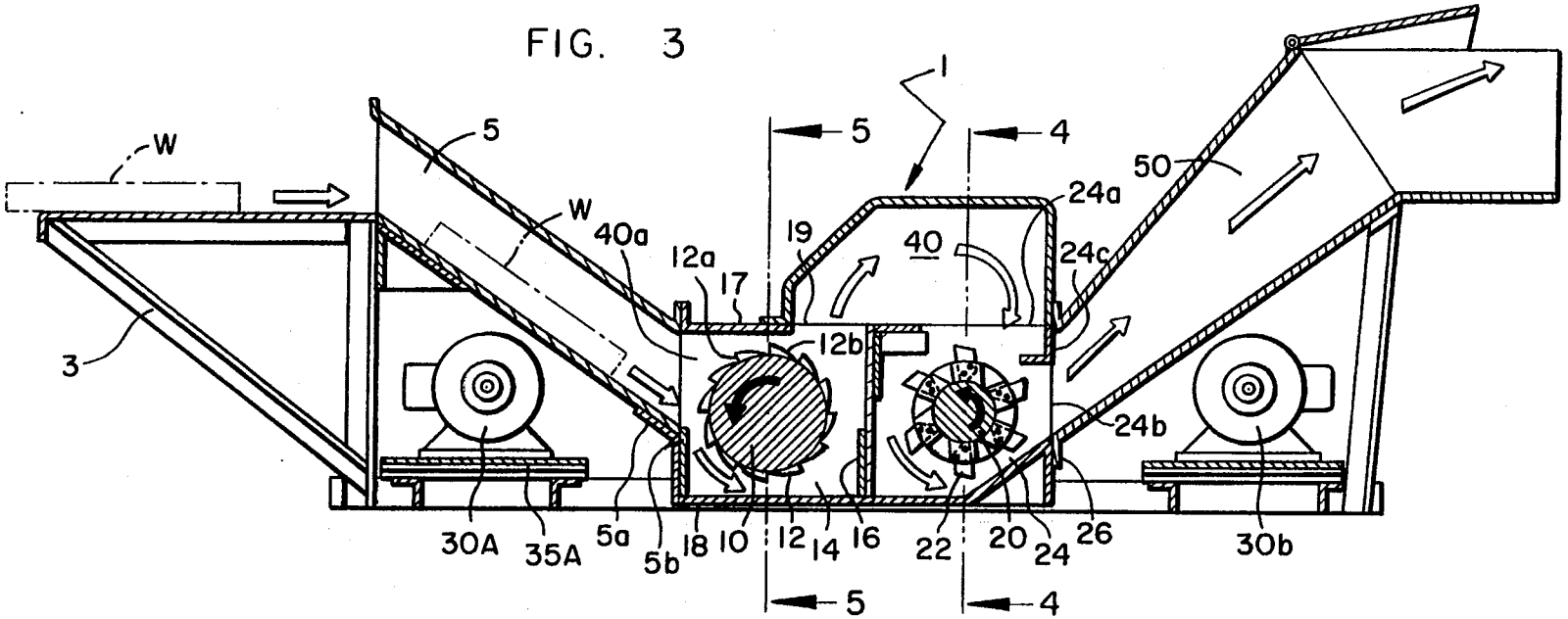
FIG. 3 is a cross-sectional view of the device taken along line 3—3 of FIG. 2.
Figure 4:
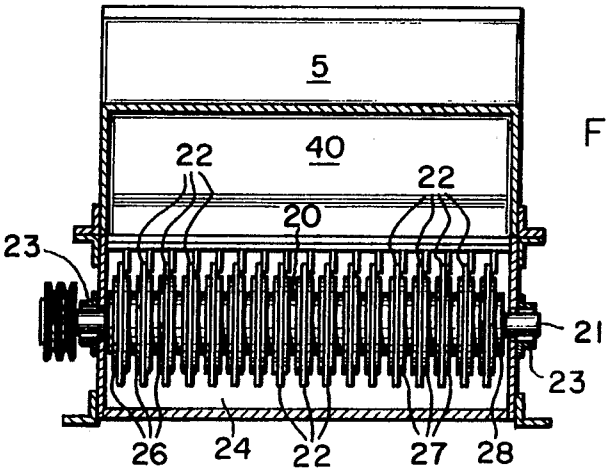
FIG. 4 is a cross-sectional view of the device taken along line 4—4 of FIG. 3.

A broad range of waste products such as cellulosic materials (e.g. wood, paper, etc.), construction materials such as paneling, floor and ceiling tiles, roofing materials (e.g. asphalt shingles), and the like may be recycled by device 1. The device 1 is particularly well suited to process compostable or cellulosic materials such as newsprint (e.g. newspapers, magazines, telephone directories, etc.), packaging materials such as cardboard, hard paper cores, etc. and a wide variety of wooden waste materials. The device 1 effectively processes large volumes of bulky wooden objects W such as wooden pallets (as illustrated in FIG. 3) into particles of a desired recyclable size.

The device 1 is durable and capable of operating continuously for prolonged operational periods without requiring major repair or maintenance. The device 1 may be provided in various different sizes, capacities and shapes. The effectiveness of the device 1 resides in its efficacy in preshredding or splintering bulky wooden objects W to a manageable preshredded fragment size followed by an expeditious processing of the preshredded fragments into shredded particles of a desirable recyclable size.

The depicted device 1 includes a platformed feed table assembly 3 for conveniently placing and feeding the pallets W onto a protectively enclosed ramped chute section 5. The chute section 5 ramps downwardly at an angular decline so as to feed a sliding pallet W at an angular positioning and appropriate gravitational rate for effective fragmenting by preshredding rotor 10. Chute 5 is sized and designed so as to feed one pallet W at a time onto the preshredding rotor 10. The angular positioning of chute floor **5*a* feeds the waste object W to the correct angular positioning for a clean break or splintering upon impacting onto impacting heads 12 of preshredding rotor 10. Other feed means such as conveyors, power feed rolls, etc., may also be used to feed product to the device 1**.

The chute floor **5*a* at its juncture onto preshredding chamber 14 serves as an anvil (5*b*) for supporting pallets W being subjected to splintering by preshredding rotor 10. The supportive structure about juncture 5*b* is reenforced so as to withstand substantial strain and stress placed upon 5*b* during the preshredding operation. The orbital motion and impacting of the preshredding rotor 10 propels the intermediate sized fragments onto the shredding chamber 24**.

The preshredding rotor 10 is equipped with a plurality of impacting heads 12 uniformly positioned about the preshredding rotor 10. The impacting heads 12 break or splinter the bulky wooden objects W into fragments of a reduced particle size. The preshredding rotor 10 will continuously fragment pallets W as fed into chute 5. The depicted impacting heads 12 are shown as having a blunt rectangular impacting face **12*a* with a trailing curvilinear supportive brace 12*b* which ultimately merges onto the curvature of the preshredding cylinder 12*c* of preshredding rotor 10. The impacting heads 12 are preferably of a durable and solid construction securely affixed (e.g. welded) to preshredding rotor 10**.

Figure 5:
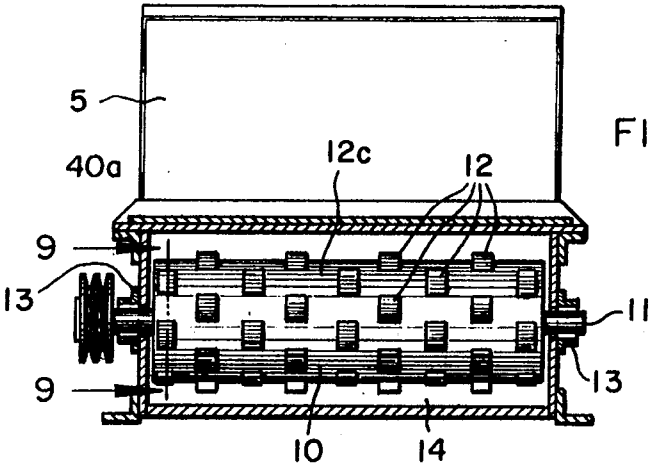
FIG. 5 is a cross-sectional view of the device taken along line 5—5 of FIG. 3.

As may be generally observed from FIGS. 3 and 5, the impacting heads 12 are placed in a balanced arrangement upon the preshredding cylinder **12*c* so that the preshredding rotor 10 is centrifugally and rotationally balanced. This balanced relationship allows the preshredding rotor 10** to evenly impact and splinter upon the bulky wooden objects W feed thereto.

The number, size, configuration and positioning of the impacting heads 12 about cylinder **12*c* may be appropriately engineered so as to yield a preshredded material of an appropriate intermediate fragment size for shredding by shredding rotor 20. The projecting height of impacting heads 12 from the surface of cylinder 12*c* controls the depth or bite of the impacting head 12 upon materials such as pallets W being fed to preshredding rotor 10. Typically, the height of head 12 from cylinder 12*c* will be less than 4 inches and more than about ¼ inch. For most applications, the impacting surface 12*a* of each impacting head 12 will advantageously project outwardly from cylinder 12*c*** a relatively small distance ranging from about ½" to about 3" and most preferably from about 1" to about 2".

Although the width of head **12*a* may vary considerably, there is no particular advantage to heads 12*a* measuring 6 or more inches in width. Advantageously, the head 12 will measure more than about ½ inch to less than about 3 inches in height with the preferred height ranging from about 1 inch to about 2 inches. The surface area for each impacting head 12** will typically amount to less than 10 square inches and advantageously less than 5 square inches with a surface area ranging from about 1 to about 4 inches square being preferably adapted to most preshredding operations.

The lateral positioning of impacting heads 12 along cylinder **12*c* will have an effect upon the splintering length. As may be observed from FIG. 5, the impacting heads 12 are placed in a rowed relationship about cylinder 12*c*. This lateral positioning will typically amount to more than about 2 inches and less than about 20 inches apart. Advantageously, the lateral placement of the impacting head 12 rows will range from about 4 inches to about 12 inches with a lateral spacing between head 12 rows ranging from about 5 inches to about 10 inches being preferred. The impacting heads 12 may be longitudinally positioned about cylinder 12*c* so that each alternate head 12 is longitudinally aligned to one another along cylinder 12*c*. The design and positioning of the impacting heads 12 will advantageously produce relatively small bites or splintering upon fed objects which is more effective and safer than larger bites or splintering. The gradient removal of smaller sized splinters from the bulky wooden objects also significantly reduces jarring and impacting upon preshredding rotor 10** while allowing for a more balanced rotation and impacting upon the fed pallets.

The illustrated preshredding rotor 10 rotationally spins in a counter clockwise manner as depicted in FIG. 3. The preshredding rotor 10 typically splinters the pallets in intermediate sized splintered particles typically varying in size of about 2 to about 20 inches in length and about 0.25 to about 4 inch thickness and advantageously of about 4 to about 12 inches in length and about 0.5 to about 2 inches thickness. An impacting head 12 measuring 1 ½ inches in height and 2 inch width, laterally spaced apart at about 6 inches and operated at 750 r.p.m. will predominantly yield splinters measuring about 1 to about 2 inches in diameter and about 8 to about 12 inches in length. Splinters of such a size may be effectively processed by shredding rotor 20.

Preshredding rotor 10, fitted with pulley 32A, is belt 34A driven by pulleyed motor 30A. The rotation of preshredding rotor 10 is depicted as being counter clockwise or downwardly onto anvil 5b. Preshredding of pallet W occurs in the throated region of chute 5 about preshredding rotor 10 which splinters pallet W into splinters measuring about ½–¾" thickness and about 6" to about 8" length. Preshredding rotor 10 generates sufficient air currents within preshredding chamber 14 to effectively propel splinters onto exit port 19 and discharge into communicating chamber 40.

The shredding rotor 20 shreds the splintered fragments into shredded particles of the described particle size. The shredding rotor 20 includes a plurality of shredding members 22 which impact upon and shred the splinters to a reduced particle size. The character of the shredded particles is generally controlled by the size, shape, positioning, and rotational speed of the shredding members 22 which impact upon the splintered fragments from preshredding chamber 14. Shredding members 22 in a patterned and balanced relationship as shown in the Figures have been found to be particularly useful in reducing the splinters to the desired recyclable particle size. Particles ranging from about a fine wood dust size to two inch cut size or more can be processed by varying the arrangement of the shredding members 22 upon shredding rotor 20.

In general, a closer lateral positioning of shredding members 22 along the longitudinal axis of shredding barrel 28 and circumferentially about barrel 28 will decrease the particle size of the shredded product. The arrangement of the shredding members 22 may be in rowed relationship (preferably of at least three circumferential rows for balance) about shredding barrel 28. Although ten or more rows of shredding members 22 may be placed about barrel 28, a six row arrangement as depicted in FIGS. 3 and 6–8 is generally sufficient for most shredding applications.

In the preferred embodiments of the invention, the preshredding rotor 10 and the shredding rotor 20 are separately housed within a preshredding chamber 14 and a shredding chamber 24. A communicating chambered zone 40a separated by a dam or wall 16 provides a means 40 for advancing splintered fragments from the preshredding chamber 14 to shredding chamber 24. Communicating chambered zone 40a in cooperative association with the rotational movement of preshredding rotor 10 and shredding rotor 20 provide a means for advancing the fragments from preshredding rotor 10 to shredding rotor 20. The rotational movement of preshredding rotor 10 and shredding rotor 20 within chambered zone 40a creates an air flow which carries most of the intermediate sized fragments or splinters of preshredding rotor 10 directly to shredding rotor 20. A very small portion of the preshredded material (bulkiest) may make a multiple pass and working by preshredding rotor 10. Dam 16 longitudinally extends across the entire length of working surface of preshredding rotor 10 and shredding rotor 20. Dam 16 separates the chambered zone 40a into two separate working zones, namely a preshredding chambered zone 14 and a shredding chambered zone 24. Material being processed by the device 1 continuously flows from the preshredding chamber 14 to the shredding chamber 24 with the rotational movement and impacting of preshredding rotor 10 upon the fragmentized material causing the preshredded fragments to flow through the communicating passageway 40a onto the working of shredding rotor 20 which shreds the fragments to the desired recyclable particle size. The bulk of intermediate sized fragments generated by preshredding rotor 10 will typically flow directly into shredding chamber 24.

As illustrated by the Figures, preshredding rotor 10 and shredding rotor 20 should include working pieces (namely the impacting projections 12 and the shredding blades 22) uniformly distributed or balancingly positioned about the preshredding rotor 10 and shredding rotor 20 so as to provide a rotationally balanced system which spins freely and uniformly about their respective shafts 11 and 21. The uniform rotational distribution of these working pieces may be tested by spin balancing techniques.

Shredding rotor 20 includes a plurality of shredding members or blades 22 uniformly positioned about the shredding rotor 20. In the preferred embodiments of the invention, the shredding rotor 20 is equipped with a plurality of shredding blades 22 which circumscribe the shredding rotor 20 in a helical pattern or arrangement of rows (e.g. 3–7 rows) with each blade 22 in a helical row being rotationally aligned along a common axial shredding plane to another shredding blade 22 in a leading and a following row. The depicted shredding rotor 20 (e.g. illustrated shaft 21 measuring 68"; 54" drum 28) contains six helical rows of blades 22 with each row containing seventeen (17) shredding blades 22. The helical rows are uniformly staggered upon the shredding rotor 20 with about 13 degree angular rotation on each successive blade 22 within each helical row, The longitudinal spacing between shredding blades 22 in each row along drum 28 amounts to 2 3/16 inches while the distance between shredding blades 22 in adjacent rows circumscribing drum 28 amounts to about six inches.

The width of the impacting edge of blades 22 are typically substantially less than the width of impacting heads 12. The impacting edge width is usually less than 1 inch and most generally less than about ¾ inch. Blades 22 having an impacting edge ranging from about ¼" to about ½" may be effectively utilized in most shredding applications. The shredding blade 22 rows are also typically laterally spaced substantially closer together than the preshredding heads 12. The shredding blades 22 are generally placed more than about ½" apart to less than about 5 inches apart, advantageously from about 1 to about 4 inches and preferably from about 2 inches to about 3 inches apart.

Each successive shredding blade 22 within each row may be appropriately rotated about the perimeter of drum 28 by thirteen degrees to provide the helical rowed pattern thereabout. In a six row pattern, each shredding blade 22 is angularly centered upon the perimeter at a sixty degree angle in relationship to those shredding blades 22 positioned in adjacent rows. It will also be observed from the drawings that the shredding blades 22 tilt slightly rearwardly (e.g. about 25 degrees) in relationship to the leading rotational blade edge. As evidenced by the aforementioned description and the drawings, particular care is taken in the design and configuration of the preshredding rotor 10 and shredding rotor 20 to optimize working efficacy and rotational balance.

Figure 7:
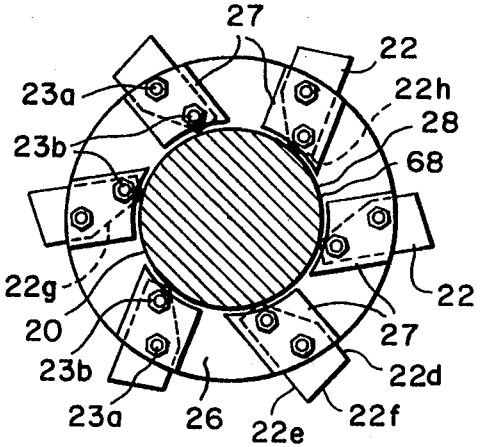
FIG. 7 is a cross-sectional view taken along line 7—7 of FIG. 6.
Figure 9:
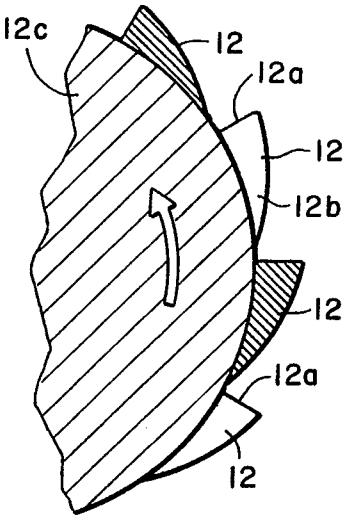
FIG. 9 is a partial view taken along lines 9—9 of FIG. 5.
Figure 6:
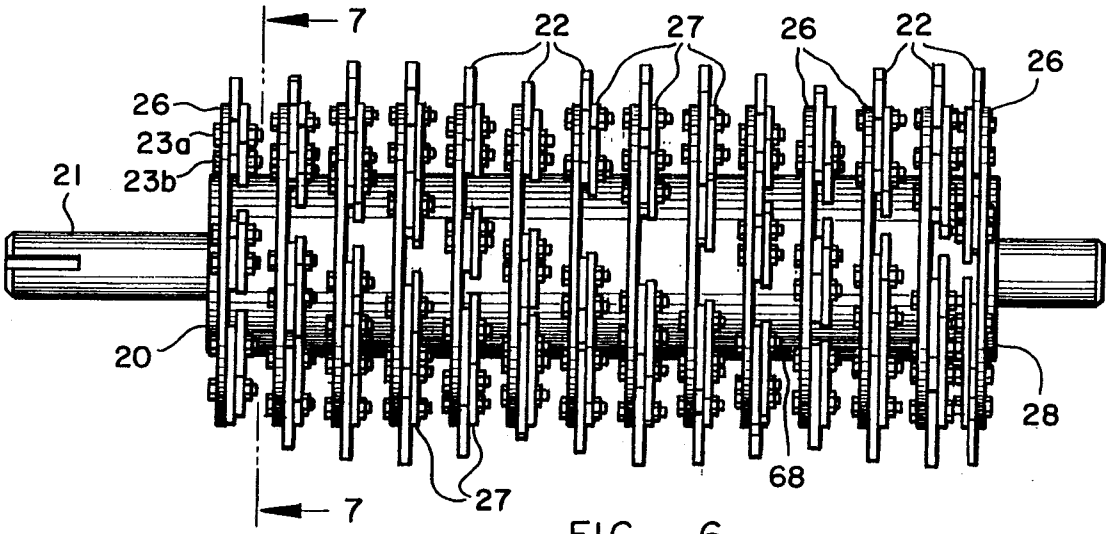
FIG. 6 is a partial view of FIG. 4.
Figure 10:
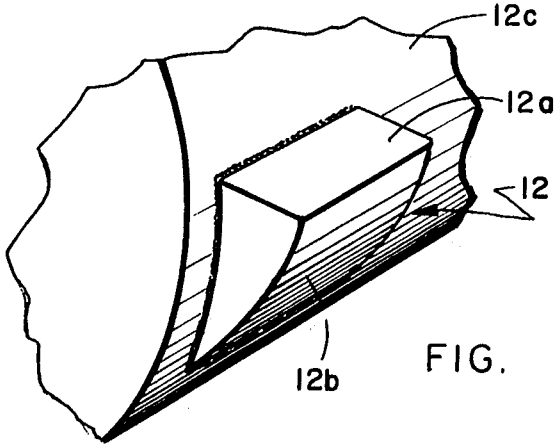
FIG. 10 is a partial perspective view of embodiments shown in FIG. 5.

The shredding blades 22 are designed to impact at a high velocity upon the preshredded fragments. The preferred shredding blades 22 as depicted in FIG. 7 are pentangular (forming five sides) in shape with a triangular cut-out section region 22*g* at the trailing base 22*h* of blade 22 to allow for pivotal movement onto shaft 21. Blades 22 are each fitted with two mounting apertures for bolting blades 22 onto retaining rings 26 and plates 27. The leading surfaces of the blades 22 may be appropriately constructed of tooled steel with a hardened facing about impacting edge 22*e*. The impacting edges 22*e* form the leading working edge for shredding fragments by rotating blade 22. The depicted blades 22 may appropriately measure ⅜ inch thickness, 2 ½ inches along top trailing side 22*d*, 5 inches along leading side 22*e*, 1 ¾ inches top trailing side 22*f*, 3 inches bottom trailing edge 22*g*, and 1 ⅛ inches along bottom edge 22*h*.

The preshredding rotor 10 and shredding rotor 20 undergo considerable pounding and impacting during their normal operational use. It is, therefore, desirable for preshredding shaft 11 of the preshredding rotor 10 as well as the shredding shaft 21 of the shredding rotor 20 to be rotationally balanced and structurally supported by strong bearing journals 13 and 23 so as to withstand the constant impacting stresses and strains placed upon shafts 11 and 21. The depicted shredding shaft 21 and preshredding shaft 11 of FIGS. 4 and 5 may appropriately include ball bearing journals 13 and 23 at both shaft ends.

Figure 8:
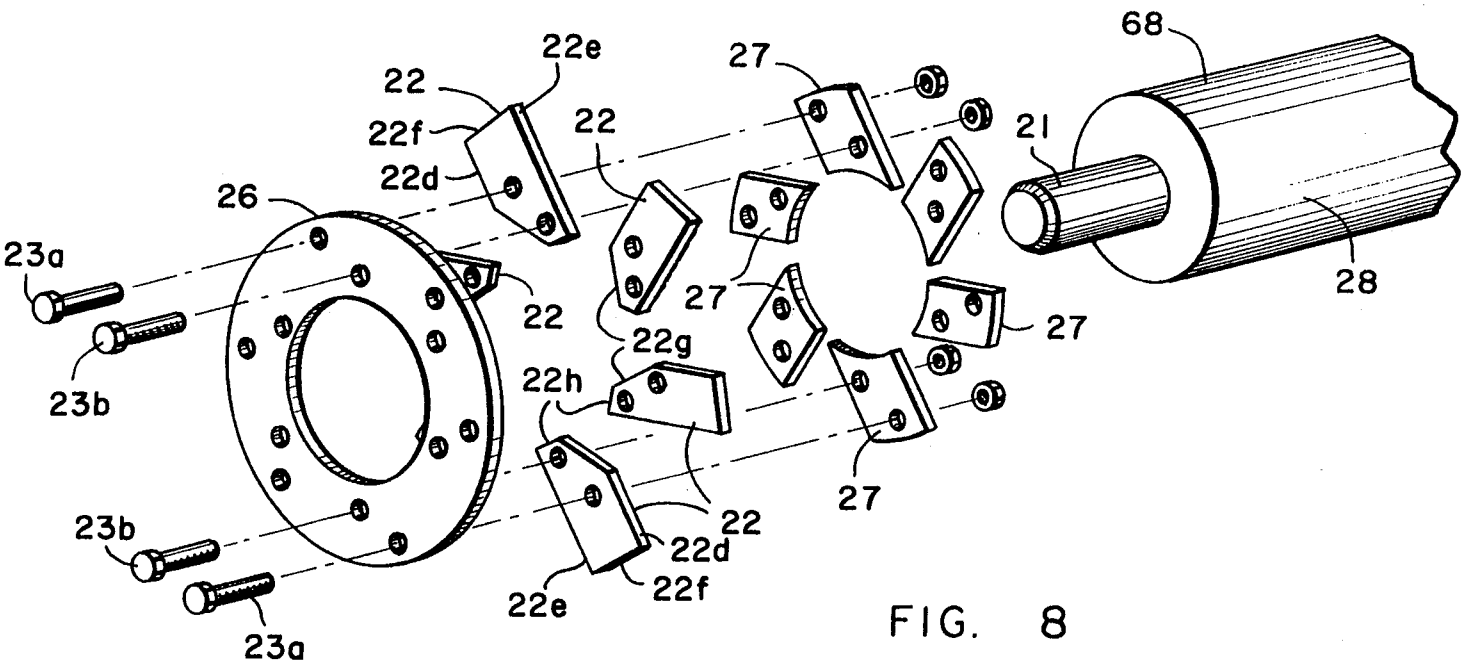
FIG. 8 is a disassembled view of certain components shown in FIGS. 2–4, 6 and 7.

Shredding blade retaining ring 26 and split plate 27 serve as mounting sites for mounting shredding blades 22 to shredding barrel 28. The retaining rings are preferably directly welded onto barrel 28 at the appropriate lateral spacing for mounting shredding blades 22 thereto. Alternatively, retaining rings 26 and the split ring plates 27 may be tapered or beveled at the barrel 28 interface so as to interlock onto barrel 28 when blades 22 are sandwiched between ring 26 and plate 27 and secured onto barrel 28. Blades 22 extend or protrude about 1 ½ inches outwardly from rings 26 with about 3 ½ inches of blades 22 being mounted within the recesses of rings 26. As illustrated in FIGS. 3, 7 and 8, each of the depicted retaining ring 26 provides a mounting site for six shredding blades 22 to be mounted along the same rotational axis.

The shredding rotor 20 is uniquely fitted with shredding blades 22 which are designed to break from their rigid mounts in the event the shredding rotor 20 impacts upon a rigid or damaging article. This embodiment of the invention protects the shredding rotor 20 from costly damage, repair and downtime. This embodiment may be observed by referring to the broken line depictions of FIG. 7, which depict shredding blades 22 as being uniquely mounted onto the shredding rings 26 in such a manner that one mounting bolt 23*a* of the two mounting bolts 23*a* and 23*b* serves as a sheer pin to protect each blade 22 against damage upon severe impacting. The retaining rings 26 and mating split plates 27 are provided at each shredding blade 22 mounting site with two bolt holes mating onto the bolt holes of shredding blades 22. The outermost mounting bolt 23*a* for mounting the shredding blades 22 onto ring 26 and split plate 27 is operationally exposed to a higher order of shear and stress than the innermost mounting bolt 23*b*. The outermost mounting bolt 23*a* thus serves as shear pin when any given shredding blade is thus operationally exposed to an abnormally high shearing force or impacting force. Thus, shredding blade 22 when impacting upon an immovable or excessively hard object will shear the outer retaining bolt 23*a* causing the shredding blade 22 to pivot about the inner bolt 23*b* and thereby protectively remain within the confines of ring 26. This permits the blade 22 to pass about or around any immovable or excessively hard object without causing extensive damage to device 1. This particular protective embodiment of the invention protects not only the blade 22 but also the bearings 23, shaft 21, drive means, and other associated equipment from damage.

Shredding chamber 24 includes a top drop port 24*a* for discharging the preshredded fragments onto the impacting action of shredding rotor 20. Preshredded fragments impact onto shredding rotor 20 and are propelled about shredding chamber 24 (about a 270 degree flight) to discharge port 24*b* for discharge through discharge pipe 50. Preshredding baffle 24*c* serves to direct air flow and shredded materials towards discharge pipe 24*b*.

The preshredding rotor 10 and shredding rotor 20 rotate in the same direction and collectively generate substantial air flow through device 1. Materials within the preshredding chamber 14 and shredding chamber 24 are thereby suspended and move through the chambers in a fluidized state as illustrated by the material flow arrows of FIG. 3. Any suitable power source and drive means (including a single motor) may be used to separately or jointly power preshredding rotor 10 and shredding rotor 20.

The preshredding rotor 10 and shredding rotor 20 are shown in the Figures as being separately powered by electrical motors 30A and 30B. The depicted drive means for powering preshredding rotor 10 and shredding rotor 20 include drive belts 34A and 34B. Rotational speed for preshredding rotor 10 and shredding rotor 20 may be accomplished by appropriate pulley sizing of pulleys 31A, 32A, 31B, and 32B to provide the appropriate rotational speeds. Motors 30A and 30B are securely mounted to mounting platforms 35A and 35B.

The rotational speeds of the preshredding rotor 10 and the shredding rotor 20 should be maintained at a rate which allows for effective flow of work materials through the device 1 while also protecting the device 1 against damage. In general, the preshredding rotor 10 is operated at a substantially lower rotational rate or speed than the shredding rotor 20. Typically, the shredding rotor 20 will be operated at a rotational speed of at least two times faster than the preshredding rotor 10. The slower r.p.m. of the preshredding rotor 10 substantially reduces attrition impacting stresses, and damage (especially in processing rigid waste materials) to the working components while also providing a relatively constant flow of appropriate sized splinters for processing within the shredding chamber 24.

Preshredding rotor 10 and shredding rotor 20 are maintained at different rotational speeds. The differences in rotational speeds contributes towards significantly improved efficacy in shredding bulky objects to a recyclable sized materials. The effectiveness in reducing the objects to recycling size, the processing rate, power and maintenance requirements are factors arising from maintaining the appropriate rotational differences between rotors 10 and 20. The rotational ratio of the shredding rotor 20 to the preshredding rotor 10 for heavy duty waste recycling will usually amount to at least 2:1, advantageously at least 5:2, and preferably at least 3:1 with rotational speed ratio of about 4:1 being most preferred for most operations.

The rotational speeds of preshredding rotor 10 and shredding rotor 20 are adjusted to match the waste material being processing by device 1. The more rigid and fracture resistant materials such as the depicted wooden pallets W will generally require a slower preshredding rotational rate than those wastes of a more fragile or readily shreddable construction such as paper wastes. Relatively rigid wastes such as wooden pallets W will typically be processed at rotational speeds of less than about 1500 r.p.m. while more fragile waste materials may be processed at higher rotational speeds such as 2500 r.p.m. or less. For most operations involving the more rigid waste materials, the preshredding rotor 10 will be advantageously operated at a speed of less than 1200 r.p.m. and preferably less than 1000 r.p.m. In the most preferred embodiments of the invention, rigid waste materials are fed to a preshredding rotor 10 operated from about 500 r.p.m. to less than about 1000 r.p.m. with exceptionally good splintering results (e.g. for wood) being achieved at a rotational speed of about 750 r.p.m. plus or minus about 100 r.p.m.

In contrast, the shredding rotor 20 is usually operated at a higher rotational rate or speed than preshredding rotor 10. The shredding rotor 20 is desirably operated at a rotational speed greater than 1000 r.p.m. and usually at a rate greater than 1500 r.p.m. Advantageously, the preshredding rotor 20 is operated at a speed greater than 2000 r.p.m. and preferably more than 2500 r.p.m. with speeds ranging from about 2500 to 3800 r.p.m. being preferred.

The working components of the device 1 are shielded to protectively confine the work material within the device 1 until processed and discharged at appropriate recyclable size. The upper housing 42 covering the preshredding chamber 14 and the shredding chamber 24 provides internal access to both chambers in case of need for repair or the unlikely need to unplug either chamber. The upper preshredding chamber housing 17 commencing at the juncture of feed chute to about the bisecting center of preshredding shaft 11 rests substantially flat and parallel to chamber bottom panel section 18. This particular design channels impacted splinters downwardly and towards the preshredding rotor 10. At about the juncture of the vertical bisecting plane of the centroid of preshredding shaft 11, the upper housing 42 is necked to incline at about a 45 degree angular incline until juncturing onto the vertical plane of dam 16 at which point the upper housing 42 thereafter rests at a substantially horizontal plane until juncturing onto the rear wall 26 of the shredding chamber 24 at which point the upper housing 42 back panel perpendicularly declines onto baffle 24c discharging chute 50.

What is claimed is:

1. A waste recycling device for reducing waste objects to a recyclable particle size, said device comprising:

a) a preshredding rotor equipped with a number of blunt impacting projections for fragmenting the waste objects into intermediate sized fragments;

b) a shredding rotor equipped with a plurality of shredding members for shredding the fragments into smaller sized particles, with the shredding members including means for protectively retracting the shredding members from a shredding zone when said shredding members are exposed to an excessive impacting force exceeding a minimum shearing force threshold for maintaining said shredding members within said shredding zone in an unretracted position;

c) means for advancing the fragments from said preshredding rotor to said shredding rotor;

d) power driven means for rotationally driving said preshredding rotor and said shredding rotor at different rotational speeds; and e) means for discharging said particles from said device.

2. The device according to claim 1 wherein the impacting projections are rotationally balanced about a rotatable preshredding shaft and individually equipped with a blunt surfaced impacting head.

3. The device according to claim 2 wherein the blunt impacting head has an impacting surface area ranging from about 1 to about 4 square inches.

4. The device according to claim 1 wherein said power driven means includes means for rotationally operating the shredding rotor at a substantially greater rotational speed than said shredding rotor.

5. The device according to claim 4 wherein power driven means includes means for respectively powering the preshredding rotor at a rotational speed ranging from about 500 r.p.m. to about 1500 r.p.m. and the shredding rotor at a rotational rate of at least 2000 r.p.m.

6. The device according to claim 5 wherein power driven means includes means for powering the rotational speed of the shredding rotor from about 2500 r.p.m. to about 4000 r.p.m.

7. A method for recycling waste objects to a recyclable particle size in a waste recycling device equipped with a rotationally balanced preshredding rotor fitted with a number of blunt projections for fragmenting the waste objects to fragments, a rotationally balanced shredding rotor fitted with shredding members for shredding the fragments into particles of a smaller size and the shredding members include means for protectively retracting the shredding members from a shredding zone when said shredding members are exposed to an excessive impacting force exceeding a minimum shearing force threshold for maintaining said shredding members within said shredding zone in an unretracted position, means for advancing the fragments to the shredding rotor from said preshredding rotor and power driven means for rotationally driving the preshredding rotor and the shredding rotor at substantially different rotational speeds, said method comprising:

a) feeding the waste objects to the preshredding rotor;

b) fragmenting the waste objects by impacting the waste objects against the number of blunt projections while maintaining the preshredding rotor at a substantially lower rotational speed than said shredding rotor;

c) allowing the fragments to advance from said preshredding rotor to a shredding zone housing the shredding rotor;

d) shredding the fragments within the shredding zone to a shredded particle size;

e) subjecting at least one of the shredding members to the excessive impacting force so as to cause one or more of the shredding members to retract from the shredding zone; and f) collecting the shredded particles.

8. The method according to claim 7 wherein the waste objects comprise wooden objects.

9. The method according to claim 7 which comprises feeding wooden pallets to the preshredding rotor.

10. The method according to claim 7 wherein the fragmenting is conducted while operating the preshredding rotor at a preshredding rotational speed of about 500 to about 1500 r.p.m.

11. The method according to claim 10 wherein the shredding rotor is maintained within the shredding zone at a rotational rate ranging from about 2500 r.p.m. to about 4000 r.p.m.

12. The method according to claim 7 wherein the method includes returning the retracted shredding members to the unretracted position.

13. A waste recycling device for reducing waste objects to a recyclable particle size, said device comprising:

a) a preshredding rotor equipped with a number of blunt impacting projections for fragmenting the waste objects into intermediate sized fragments;

b) a shredding rotor equipped with a plurality of shredding members for shredding the fragments into smaller sized particles and wherein the shredding rotor is equipped with means for protectively retracting the shredding members from a shredding zone when said shredding members are exposed to an excessive impacting force exceeding a minimum shearing force threshold for maintaining said shredding members within said shredding zone in an unretracted position;

c) means for advancing the fragments from said preshredding rotor to said shredding rotor;

d) power driven means for rotationally driving said preshredding rotor and said shredding rotor at different rotational speeds; and e) means for discharging said particles from said device.

14. The device according to claim 13 wherein the means for protectively retracting the shredding members includes retaining rings which circumscribe a rotatable shredding shaft and the retaining rings support the shredding members in the unretracted position within said shredding zone and protectively shield the shredding members from the shredding zone when said shredding members are exposed to said excessive impacting force.

15. The device according to claim 14 wherein the rings and shredding members are sized so as to allow for the shredding members to retract within a peripheral margin of the rings when said shredding members are exposed to said excessive impacting force.

16. The device according to claim 15 wherein the retaining rings include for each of said shredding members mounted thereto a first mounting site and a second mounting site with said second mounting site being positioned upon the ring so as to provide a substantially higher exposure to shear forces than said first mounting site.

17. The device according to claim 16 wherein the first mounting site is positioned in closer proximity to the rotatable shaft than said second mounting site.

18. The device according to claim 17 wherein the first mounting site serves as a pivotal mount and the second mounting site serves as a shear pin.

* * * * *